US005519180A

United States Patent [19]

Zaffetti et al.

[11] Patent Number: 5,519,180

[45] Date of Patent: May 21, 1996

[54] METHOD FOR CONTROLLING CONTACT DEPRESSION FOR HIGH AMPERE-RATED CIRCUIT

[75] Inventors: Mark A. Zaffetti, Windsor Locks; James L. Rosen, West Hartford; David Arnold, Chester, all of Conn.

[73] Assignee: General Electric Company, New York, N.Y.

[21] Appl. No.: 286,572

[22] Filed: Aug. 8, 1994

[51] Int. Cl.[6] ..... H01H 5/00

[52] U.S. Cl. ..... 200/401; 200/400; 335/16

[58] Field of Search ..... 200/400, 401, 200/251; 335/16, 6, 7, 9, 15; 74/2

[56] References Cited

U.S. PATENT DOCUMENTS

| | | | |
|---|---|---|---|
| 3,735,075 | 5/1973 | Kidd | 200/251 |
| 3,755,638 | 8/1973 | Lucas et al. | 200/251 |
| 4,001,742 | 6/1977 | Jencks . | |

OTHER PUBLICATIONS

Castonguay et al., "A system for resetting high ampere–rated circuit breaker operating springs"; U.S. Ser. No. 08/228,761 Filed Apr. 19, 1994.

Castonguay et al, "Rating module unit for high ampere–rated circuit breaker" U.S. Ser. No. 08/203,062 filed Feb. 28, 1994.

*Primary Examiner*—David J. Walczak

*Attorney, Agent, or Firm*—Richard A. Menelly

[57] ABSTRACT

The contact depression effected between the fixed and moveable contacts in a high ampere-rated circuit breaker is fixed after assembly of the current carrying components by the provision of a multi-dimensional contact carrier support bearing. The selection of the support bearing dimension fixes the height of the movable contact arm and the attached movable contact relative to the subjacent fixed contact. Control of the contact depression improves circuit interruption efficiency and extends the operating life of the circuit breaker contacts.

14 Claims, 3 Drawing Sheets

METHOD FOR CONTROLLING CONTACT DEPRESSION FOR HIGH AMPERE-RATED CIRCUIT

BACKGROUND OF THE INVENTION

U.S. Pat. No. 4,001,742 entitled "Circuit Breaker Having Improved Operating Mechanism" describes an early operating mechanism for high ampere-rated circuit breakers. A more recent description is found within U.S. patent application Ser. No. 08/228,761 filed Apr. 18, 1994 entitled "A System for Resetting High Ampere-rated Circuit Breaker Operating Springs".

With such high ampere-rated circuit breakers, a pair of main contacts is employed to carry steady state circuit current and a separate pair of arcing contacts is required to handle the large currents that occur in an overcurrent circuit interruption. The so-called "contact depression" whereby the movable contacts press against the stationary contacts within both the main and arcing contacts, is carefully adjusted in the final stages of the circuit breaker assembly process. The current-carrying components are usually dismantled and the tolerances that exist with the operating mechanism components is compensated by adjustments of individual components.

In a high speed assembly process utilizing automatic assembly equipment in some stages of assembly, the efficiency of the process is decreased by the time required to dis-assemble and re-assemble these components.

One purpose of the invention is to set the contact depression in accordance with the component tolerance in the final stages of the assembly of the current-carrying components without involving a large number of components or requiring the expenditure of substantial manufacturing time.

SUMMARY OF THE INVENTION

The contact depression of the main and arcing contacts used within high ampere-rated circuit breakers is carefully set during the final assembly of the circuit breaker components to minimize the effects of component tolerances. A multi-dimensional contact carrier support bearing is utilized to attach the movable contact arm carrier to the operating mechanism torque shaft to set the relative position of the fixed and movable contacts.

DESCRIPTION OF THE PREFERRED EMBODIMENT

Figure 1:
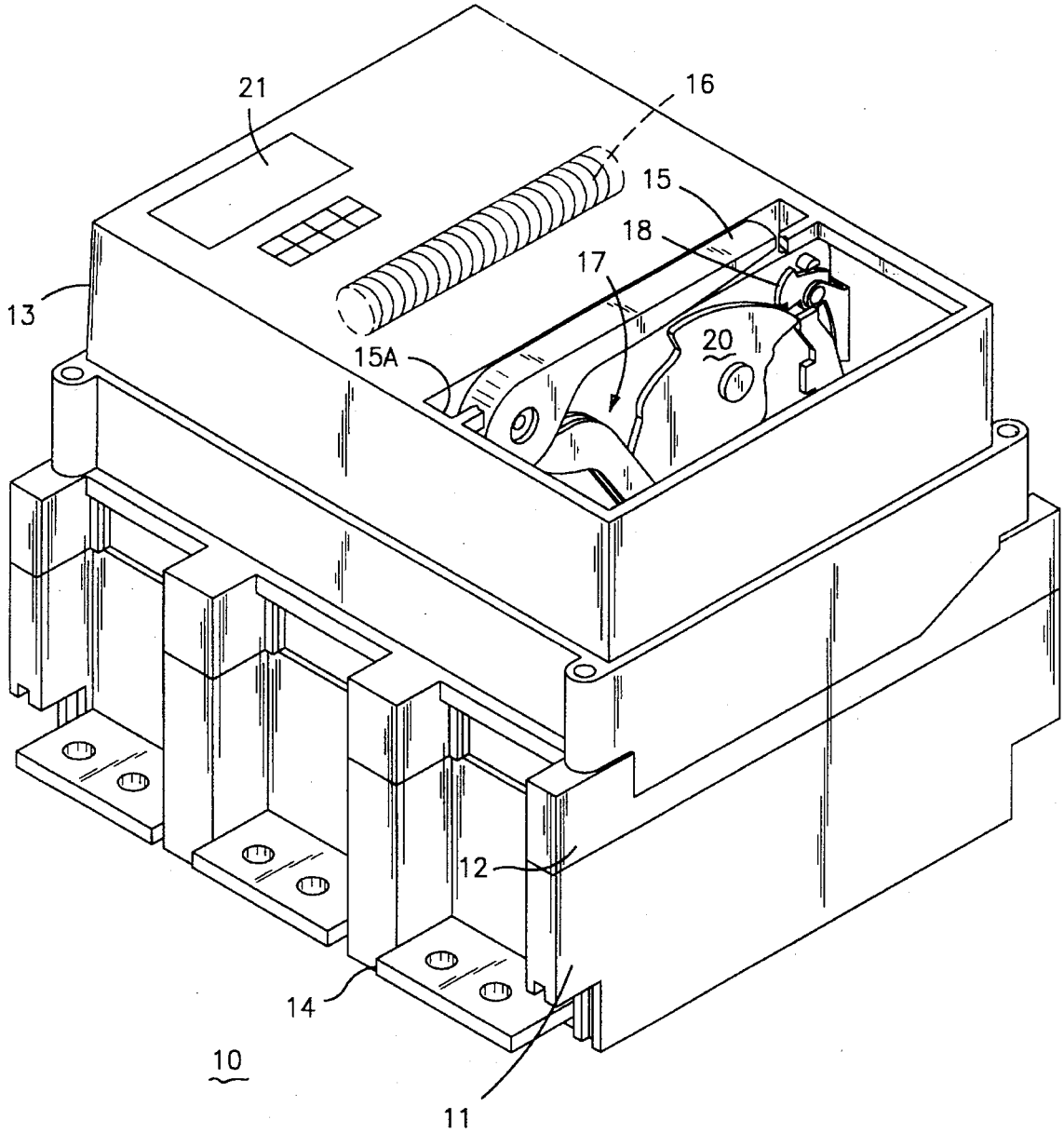
FIG. 1 is a top perspective view of the high ampere-rated circuit breaker in accordance with the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit 21 contained within a recess on the top surface of the top cover 13. The operating mechanism 17 as described Within U.S. patent application (41PR-7124) includes a torque shaft 19 which provides the forces required to charge the powerful operating mechanism springs 16. The operating handle 15 located within the handle recess 15A provides manual means for charging the operating mechanism springs through operation of a handle drive gear 20 and cam assembly 18.

Figure 2:
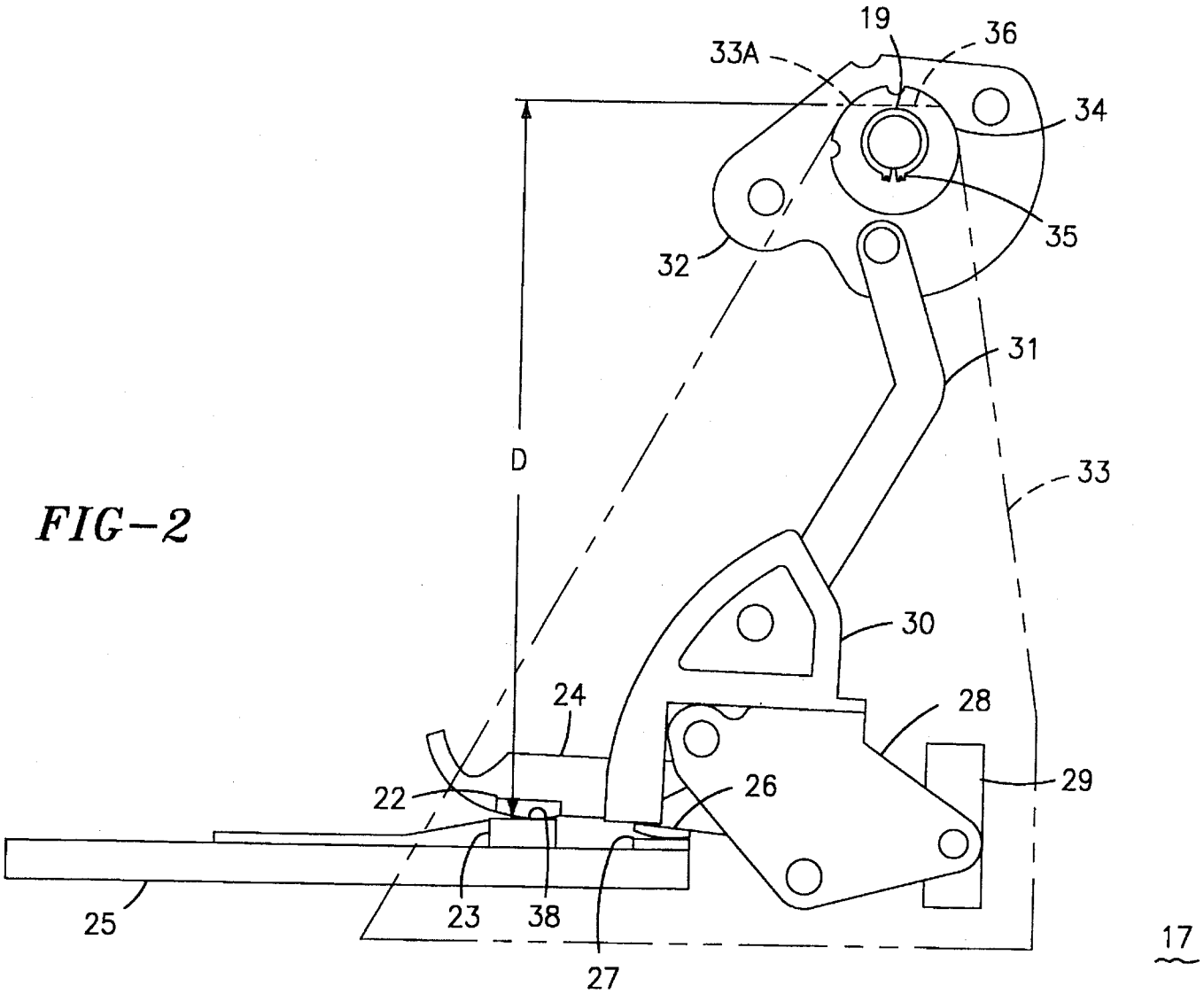
FIG. 2 is an enlarged side view of the movable contact arm assembly used within the circuit breaker of FIG. 1.

Referring to FIG. 2, a part of the operating mechanism 17 includes the torque shaft 19 which is supported upon a pair of supports 33, one of which is depicted in phantom. The shaft is attached by a flange 32 and connector links 31 to the contact arm carrier 28 and establishes the distance D between the contact depression line 38 to which the movable arcing contact 22 extends into the fixed arcing contact 23 and the contact depression of the movable main contact 26 into the fixed main contact 27. The contact arrangement is similar to that described within the aforementioned U.S. Pat. No. 4,001,742 wherein the arcing contacts separate after the main contacts to deter arc formation between the main current carrying contacts. The fixed contacts are supported on a support 25 which comprises the line strap and the movable contacts are carried by a movable contact arm 24 which electrically connects with the load pivot strap 29. The insulative block 30 electrically isolates the contacts from the operating mechanism assembly. In prior circuit breakers, the distance D was set by a careful positioning of the structural components within the operating mechanism and the final adjustment via shims and the like was made by disassembling the shaft 19 to access the intervening components. In accordance with the invention, the distance D is set at the final stage of assembling the adjustable support bearing 34 that rotatably supports the shaft 19 on the supports 33. The adjustable support bearing 34 is provided with a planar outer surface 36 upon which the top 33A of the support is attached before the bearing is attached to the shaft by means of the locking clip 35. The adjustment of the distance D in the final stages of assembly, allowing for the tolerance accumulation without having to re-assemble and adjust to close tolerance, is best seen by now referring to the arrangement depicted in FIG. 3 wherein the shaft 19 is shown with the adjustable support bearing 34 prior to positioning on the support 33. At this stage in the assembly process, distance D (FIG. 2) is determined and the outer surface 36 of the adjustable support bearing is selected before positioning the adjustable support bearing on the support.

Figure 4:
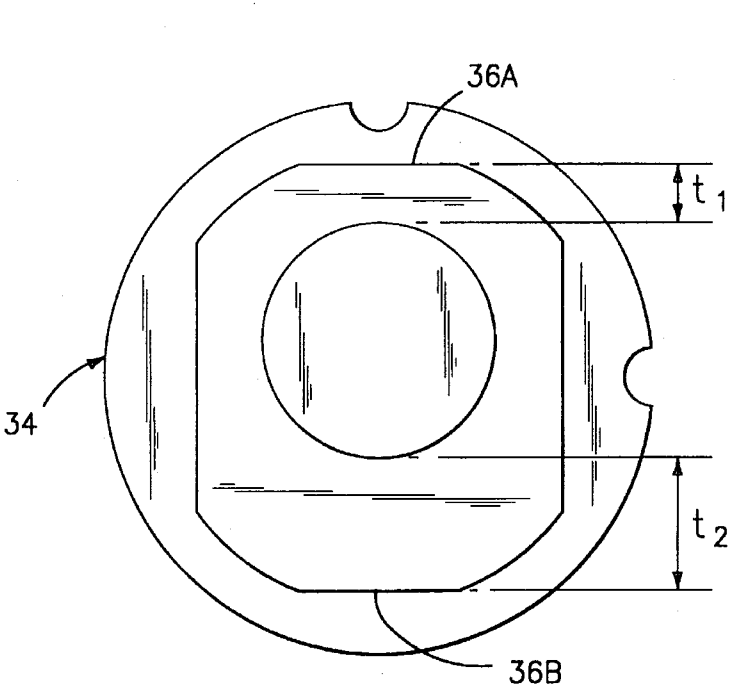
FIG. 4 is an enlarged end of the adjustable support bearing of FIG. 3.
Figure 3:
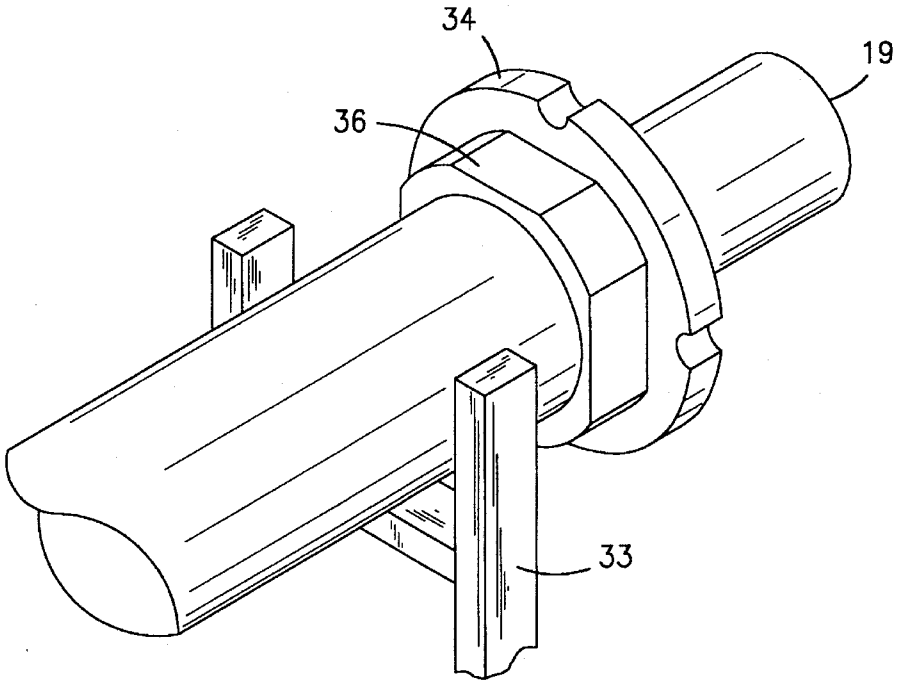
FIG. 3 is an enlarged top perspective view of the support arrangement between the contact carrier sideframe and the adjustable support bearing.

The geometry of the adjustable support bearing 34 is shown in FIG. 4 which is now referred conjointly with FIG. 3 to show the different outer surface dimensions t1 and t2 provided on the outer surface 36A, 36B respectively. The dimensions were selected as best fitting the accumulated tolerances that occur in the controlled circuit breaker assembly process such that more or less distance is required to optimize the contact depression between the fixed and movable contacts described earlier. In other words, the tolerances are allowed to accumulate in known fashion rather that controlling and adjusting the individual component tolerances at a great expenditure of assembly time and expense.

We claim:

1. A circuit breaker contact arm assembly comprising:

a fixed and a movable contact arranged for separation upon the occurrence of an overcurrent condition through a protected circuit;

a trip unit arranged for determining the occurrence of an overcurrent condition and actuating an operating mechanism to separate said contacts;

a shaft within said operating mechanism and attached to said movable contact by a connector link and a flange providing opening and closing force to said movable contact;

a support supporting said shaft; and an adjustable support bearing rotatably supporting said shaft to said support, said bearing having means for determining the degree of contact depression of said movable contact into said fixed contact.

2. The circuit breaker contact arm assembly of claim 1 wherein said bearing is removably attached to said shaft by means of a locking clip.

3. The circuit breaker contact arm assembly of claim 1 wherein said bearing comprises a planar outer surface.

4. The circuit breaker contact arm assembly of claim 3 wherein said planar outer surface is selected to set the degree of contact depression of said movable contact into said fixed contact.

5. The circuit breaker contact arm assembly of claim 1 including a pair of opposing planar surfaces on said bearing.

6. The circuit breaker contact arm assembly of claim 1 including an additional fixed contact and an additional movable contact arranged for separation before said fixed and said movable contact.

7. A method of assembling a circuit breaker movable contact arm arrangement comprising the steps of:

providing a movable contact arm having a movable contact affixed to one end, said movable contact arm being connected with a shaft by means of a flange and an adjustable bearing;

providing a fixed contact support having a fixed contact affixed to one end;

determining the degree of contact depression of said movable contact into said fixed contact; and arranging said adjustable bearing to set said the degree of contact depression.

8. The method of claim 7 including the steps of providing a first and second planar surface on said adjustable bearing.

9. A circuit breaker having controlled contact depression comprising:

an enclosure consisting of an insulated case and an insulate cover;

a fixed and a movable contact within said case arranged for separation upon the occurrence of an overcurrent condition through a protected circuit;

a trip unit within said cover arranged for determining the occurrence of an overcurrent condition and actuating an operating mechanism to separate said contacts;

a shaft within said operating mechanism and attached to said movable contact by a connector link and a flange providing opening and closing force to said movable contact;

a support supporting said shaft; and an adjustable support bearing rotatably supporting said shaft to said support, said bearing having means for determining the degree of contact depression of said movable contact into said fixed contact.

10. The circuit breaker of claim 9 wherein said bearing is removably attached to said shaft by means of a locking clip.

11. The circuit breaker of claim 9 wherein said bearing comprises a planar outer surface.

12. The circuit breaker of claim 11 wherein said planar outer surface is selected to set the degree of contact depression of said movable contact into said fixed contact.

13. The circuit breaker of claim 12 including an additional fixed contact and an additional movable contact arranged for separation before said fixed and said movable contact.

14. The circuit breaker of claim 9 including an additional fixed contact and an additional movable contact arranged for separation before said fixed and said movable contact.

* * * * *